United States Patent [19]

Riley

[11] Patent Number: 4,723,928

[45] Date of Patent: Feb. 9, 1988

[54] OUTBOARD ENGINE BRACING SYSTEM

[75] Inventor: William D. Riley, Sarasota, Fla.

[73] Assignee: Donzi Marine, Tallevast, Fla.

[21] Appl. No.: 911,056

[22] Filed: Sep. 24, 1986

[51] Int. Cl.[4] ..... B63B 1/08

[52] U.S. Cl. ..... 440/900; 248/640; 114/56; 440/66

[58] Field of Search ..... 114/357, 355, 271, 291, 114/56, 61; 248/640–643; 440/900, 66–69; D12/300, 317, 318, 313, 314

[56] References Cited

U.S. PATENT DOCUMENTS

| | | | |
|---|---|---|---|
| D. 245,902 | 9/1977 | Rogers | D12/6 |
| 1,205,776 | 11/1916 | Morgan | 115/0.5 |
| 2,842,086 | 7/1958 | Yost | 115/0.5 |
| 2,945,466 | 7/1960 | Shelton | D12/310 |
| 3,763,810 | 10/1973 | Payne | 114/291 |
| 4,302,195 | 11/1981 | Bryant | 440/61 |
| 4,383,828 | 5/1983 | Wynne | 440/69 |
| 4,548,155 | 10/1985 | Hegg et al. | 114/362 |

FOREIGN PATENT DOCUMENTS

| | | | |
|---|---|---|---|
| 152691 | 9/1983 | Japan | 114/56 |

*Primary Examiner*—Joseph F. Peters, Jr.
*Assistant Examiner*—Edwin L. Swinehart
*Attorney, Agent, or Firm*—Karen M. Gerken; Jack Q. Lever; Martin P. Hoffman

[57] ABSTRACT

An outboard engine bracing system for utilization on a boat hull having a transom. The outboard engine bracing system comprises an outboard extension formed integral with the boat hull and being located above the actual transom of the hull and extending rearwardly beyond the transom. A plurality of brackets are interposed between the transom and the outboard extension, being formed integral with the transom and the outboard extension. The outboard engine bracing system is adapted to have mounted thereon a conventional outboard motor.

13 Claims, 6 Drawing Figures

OUTBOARD ENGINE BRACING SYSTEM

BACKGROUND OF THE INVENTION

1. Field of the Invention

The present invention relates to a bracing system, integral with a boat hull, for mounting an outboard motor aft of the transom of the hull. The invention is particularly adapted for large boats, such as those utilized for fishing, and high motor horsepower applications where placement of the motor aft of the transom insures that engine torque is directed away from the transom, thereby alleviating stresses imposed on the transom. The subject outboard engine bracing system is characterized by structural bracing integral with a boat hull at the location of major engine torque stress points so as to provide exceptional strength to the outboard engine mounting area.

Additionally, placement of the motor fully aft of the hull transom according to the instant invention guarantees the delivery of clear, unaerated water to the engine propellers. The outboard engine bracing system thus should help to reduce the undesirable effects associated with cavitation which occur when the outboard motor is mounted on the transom or proximate thereto. Mounting of the outboard engine directly on a conventional boat transom, as is currently done, inevitably results in partial vacuum conditions surrounding the propellers during operation of the engine with consequent engine overspeed and inefficiencies. The bracing system of the present invention seeks to overcome these deficiencies by insuring that the propellers are surrounded by unaerated water, thereby greatly enhancing engine efficiency and performance.

The outboard engine bracing system also provides a unique safety feature in the form of an outboard motor well isolated from occupiable deck areas while allowing for full utilization of the entire hull length for usuable cockpit space.

2. Description of the Prior Art

Several prior art patents are directed to platforms or extensions provided on a boat aft of the transom. For example, U.S. Pat. No. 4,548,155 discloses a swim platform which extends rearwardly of a boat hull a sufficient distance and width to accommodate a ski.

U.S. Pat. No. 4,383,828 is directed to a yacht having propeller pockets formed in the hull such that the propellers are disposed in extension portions of the pockets aft of the transom.

U.S. Pat. No. Des. 245,902 discloses an ornamental design for a boat having an extended rear portion.

It is also known in the prior art to provide a separate motor mounting support on or to the rear of the transom of a boat. For example, U.S. Pat. No. 2,842,086 discloses a fuel tank attached to the outer face of a transom and being adapted to accommodate the clamping member of an outboard motor.

U.S. Pat. No. 1,205,776 is directed to a motor supporting board interposed between extensions of the gunwales and keel of a boat rearwardly of the transom and being secured thereto by means of braces.

The prior art does not teach or suggest an outboard engine bracing system integral with a boat hull for mounting an outboard motor rear of the transom of the boat and having the attributes and features of the present invention.

SUMMARY OF THE INVENTION

The invention is directed to an outboard engine bracing system for mounting an outboard motor aft of the transom of a boat hull. The outboard motor bracing system comprises a hull extension formed integral with a boat hull and being provided with a generally rectangular hull extension recess. A deck member, adapted to be assembled over the hull, is formed with a similar integral deck extension having a motor well configured so as to fit within the hull extension recess. When the hull and deck are assembled, the hull and deck extensions form a unitary outboard extension with the motor well disposed within the hull extension recess such that the motor well is accessible from the deck of the boat. A plurality of integral brackets are interposed between the transom of the hull and the bottom surface of the outboard extension. The outboard extension is adapted to have mounted thereon a conventional outboard engine.

These features, as well as the aforementioned objects and attributes of the invention, will be more readily understood and appreciated by reference to the following description taken in conjunction with the following drawings.

DETAILED DESCRIPTION OF THE PREFERRED EMBODIMENT

Figure 1:
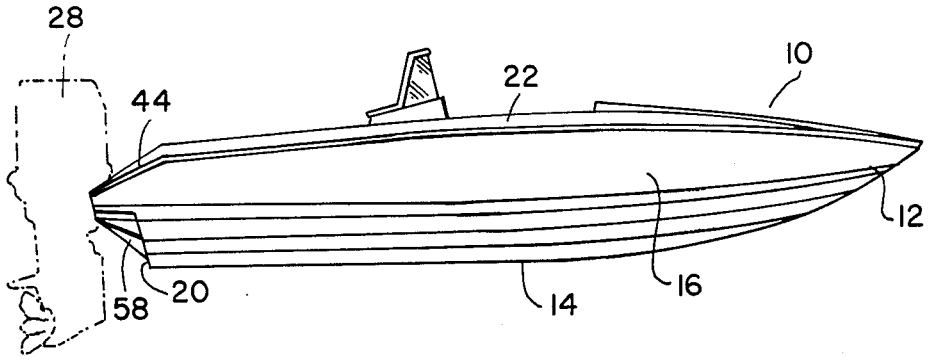
FIG. 1 is a side elevational view of a boat hull provided with the outboard engine bracing system.
Figure 2:
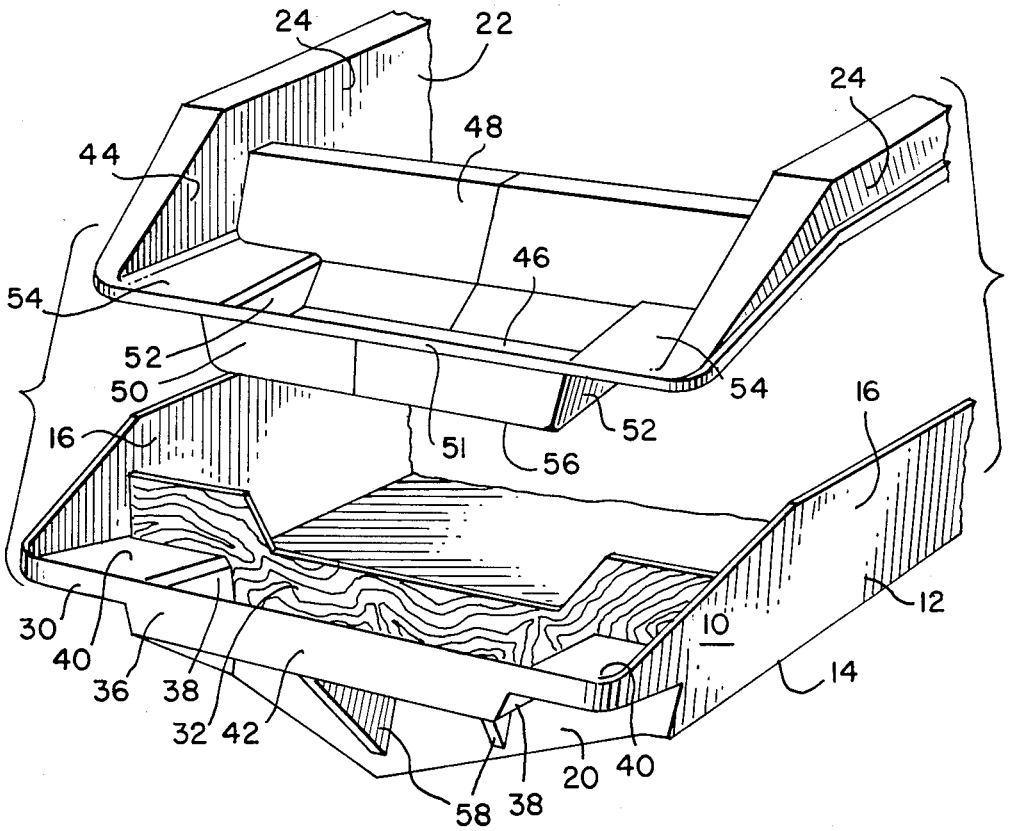
FIG. 2 is an exploded perspective view of a portion of the stern of the boat hull of FIG. 1 showing the outboard engine bracing system in an unassembled condition.
Figure 3:
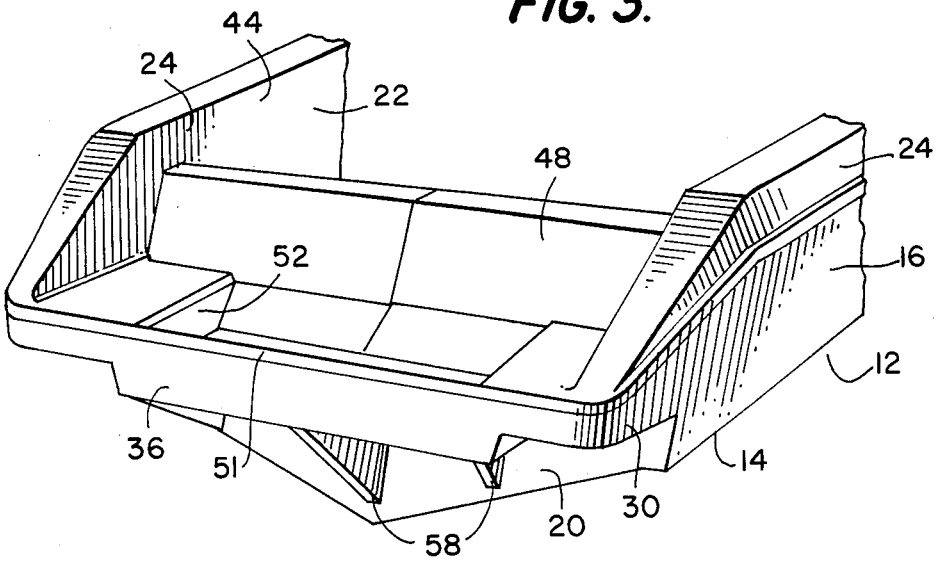
FIG. 3 is a perspective view of the portion of the stern depicted in FIG. 2 showing the outboard engine bracing system in an assembled condition.

With reference to the drawings, and in particular FIGS. 1–3, the outboard engine bracing system is adpated to be utilized on a boat 10 comprising a hull 12 of one-piece construction extending the full length and width of the boat and being molded of fiberglass or any suitable flotation material. The hull is defined at the bottom by keel 14, at the sides by side walls 16, and at the rear by transom 20. Hull 12 is joined by suitable means to a similarly formed one-piece deck member 22. The deck member is formed with a floor area interposed between side walls 24, so as to provide a cockpit area (not shown) which may accommodate various accoutrements such as passenger seats and a fishing tower. A fuel tank may be provided beneath the deck member for providing fuel to an outboard motor, shown in phantom at 28, by means of hoses or other suitable connections (not shown).

As is best depicted in FIG. 2, the outboard engine bracing system comprises a hull extension 30, formed integral with hull 12 and being located above the actual transom and extending rearwardly beyond the transom. Hull extension 30 is provided at the bottom with an enclosed, generally rectangular hull extension recess 32 defined by an upwardly extending vertical forward partition 34, a vertical rear wall 36, vertical side walls 38, each of which terminates in horizontal shelf portions 40, and a bottom surface 42. Shelf portions 40 are formed integral with side walls 16 of the hull. Rear wall 36 also serves as the rearmost wall of the hull aft of the transom.

With further reference to FIG. 2, deck member 22 is formed with a similar integral deck extension, indicated generally at 44. Deck extension 44 is defined at the bottom by an enclosed motor well 46 which is configured so as to fit within the hull extension recess 32. Motor well 46 is provided with an upwardly extending vertical forward ledge 48 adapted to be disposed over partition 34, a vertical rear wall 50 terminating in edge 51, vertical side walls 52, each of which terminates in horizontal shelf portions 54, and a bottom surface 56. Shelf portions 54 are formed integral with side walls 24 of the deck member. Edge 51 also serves as the rearmost edge of the deck member aft of the transom.

The deck member 22 is adapted to be assembled over hull 12 and joined thereto by suitable means so as to form the unitary outboard extension illustrated in FIG. 3. In the assembled condition, forward ledge 48 is disposed over forward partition 34, motor well 46 is received within hull extension recess 32, shelf members 54 are disposed over shelf members 40 with edge 51 and rear wall 36 and side walls 24 and 16 of the deck member and hull, respectively, being substantially aligned to form a unitary double hull boat construction. The opening in motor well 46 is accessible from the occupiable deck area.

Figure 4:
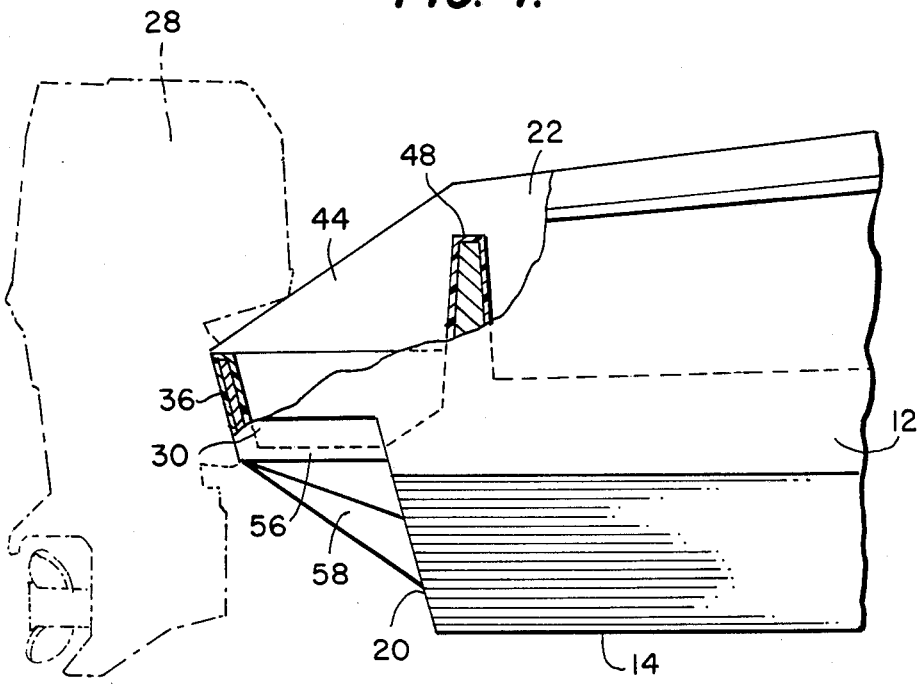
FIG. 4 is a fragmentary side view of the outboard engine bracing system with a portion of the boat hull and deck being cut away.
Figure 5:
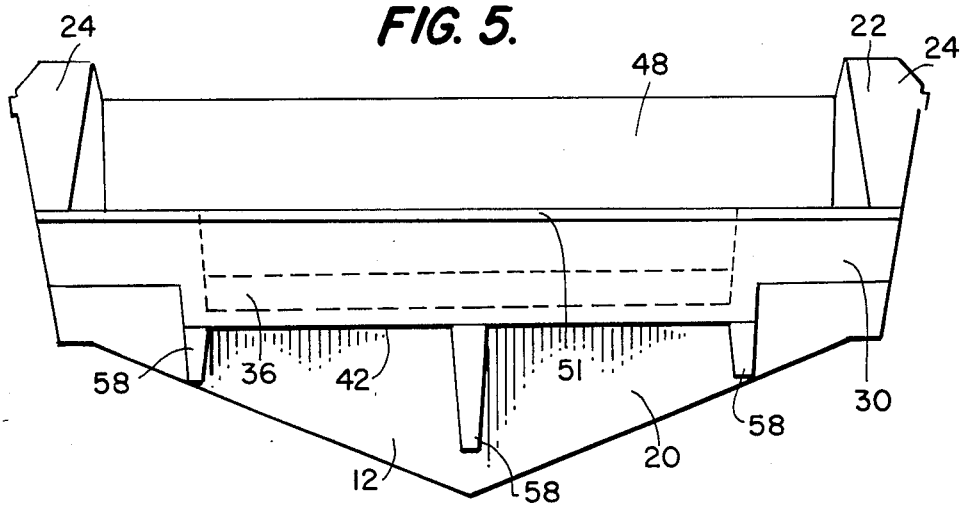
FIG. 5 is a rear elevational view of the outboard engine bracing system.
Figure 6:
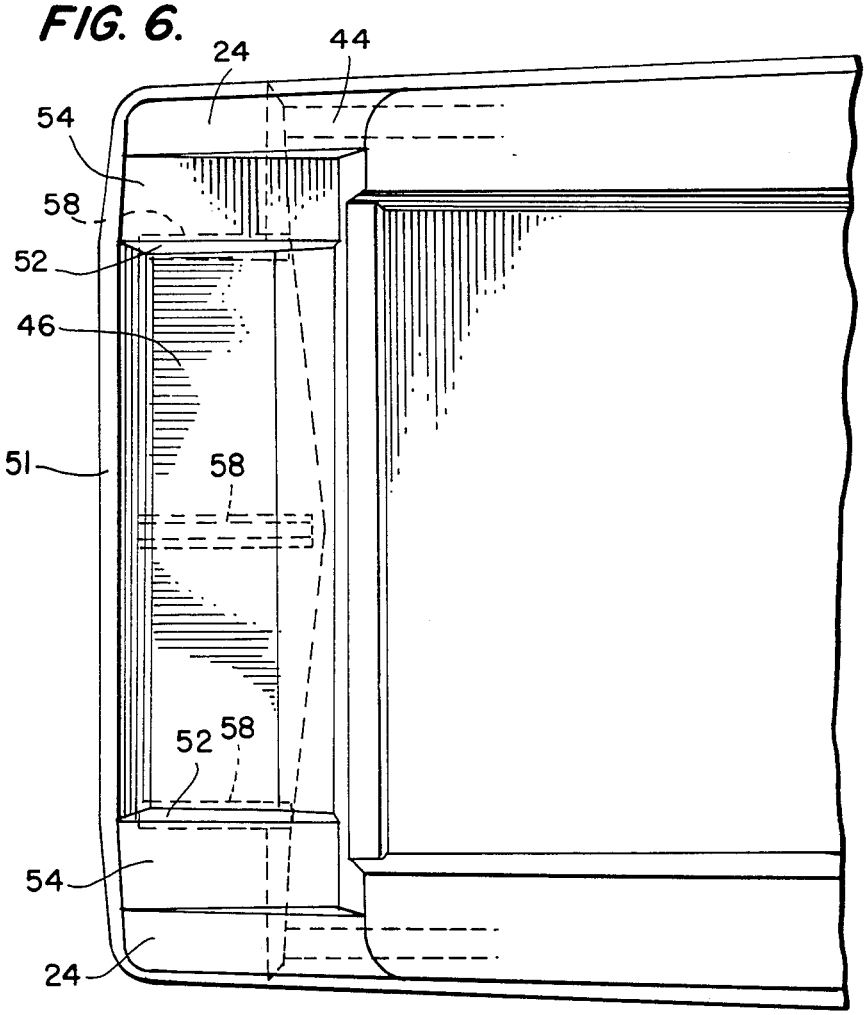
FIG. 6 is a fragmentary top plan view of the outboard engine bracing system.

As is shown in FIGS. 3–6, a plurality of brackets 58, preferably three in number, are provided interposed between the transom 20 and the bottom surface 42 of the hull extension recess 32 and are formed integral therewith. A bracket is provided on each side of the bottom surface 42 of hull extension recess 32, as well as in the center thereof. The brackets are thus located to provide structural integrity at points of critical stress. With particular reference to FIG. 5, it can be seen that the brackets are configured to conform to the bottom shape of the hull 12, a V-shaped hull as illustrated herein, with the two side brackets being shorter in length than the center bracket. It is to be understood, however, that the outboard engine bracing system is adapted to be utilized on any type hull configuration and, hence, is not limited to the V-shaped construction shown by way of example herein.

As illustrated in FIGS. 1 and 4, an outboard engine, or motor, 28 may be mounted on the outboard extension by any suitable mounting means (not shown). The outboard engine bracing system thereby positions the motor aft of the transom with the consequent benefits of increased engine efficiency and performance, as well as enhanced structural integrity and longevity of the boat hull.

Electrical and fuel connections may be made from the engine or motor to an area below the deck through any portion of the bracing system, and in particular, through access openings (not shown) which may be provided in side walls 52 of motor well 46. The subject outboard engine bracing system thereby provides a safety feature in that the engine and associated connections are isolated in the motor well away from the occupiable cockpit area while allowing for full utilization of the entire hull length.

While the invention has been described with respect to a preferred embodiment, it is to be appreciated that many modifications and changes may be made by those skilled in the art without departing from the spirit of the invention. It is apparent, therefore, that the appended claims must be interpreted to include all such modifications and changes as fall within the intended spirit and scope of the invention as defined by the appended claims.

What is claimed is:

1. An outboard engine bracing system, in combination with a deck member and a boat hull having a transom, said deck member adapted to be assembled over said hull, comprising a hull extension, said hull extension being integral with said hull, said hull extension being located above said transom and extending rearwardly beyond said transom, a hull extension recess formed in said hull extension, a deck extension, said deck extension being integral with said deck member, said deck extension extending beyond said transom, a motor well formed in said deck extension, said motor well adapted to be received within said hull extension recess when said hull and deck member are assembled, said hull and deck extensions together forming a unitary outboard extension when said hull and deck member are assembled and a plurality of brackets interposed between said transom and said outboard extension, said brackets being formed integral with said transom and said outboard extension.

2. the outboard engine bracing system recited in claim 1 wherein said hull extension recess is defined by a forward partition, a rear wall, a pair of side walls and a bottom surface.

3. The outboard engine bracing system recited in claim 2 wherein said brackets are interposed between said transom and said bottom surface.

4. The outboard engine bracing system recited in claim 3 wherein the number of brackets is three.

5. The outboard engine bracing system recited in claim 4 wherein a bracket is provided between said transom and said bottom surface proximate each of said side walls and the other of said brackets is provided between said transom and said bottom surface towards the center of said bottom surface.

6. The outboard engine bracing system recited in claim 1 wherein said hull and said deck member are made of fiberglass.

7. An outboard engine bracing system, in combination with a boat hull having a pair of side walls and a transom, comprising an outboard extension, said outboard extension being integral with said hull, said outboard extension being defined by a pair of extension side walls and an extension rear wall, said extension side walls being formed as a continuation of said side walls of said hull, said extension rear wall extending between said extension side walls, said outboard extension being located above and extending rearwardly beyond said transom, at least one support member interposed between said transom and said outboard extension, said support member being formed integral with said transom and said outboard extension, and a motor well formed in said outboard extension with the confines said extension side and rear walls.

8. The outboard engine bracing system recited in claim 7 wherein said motor well is defined by a forward ledge, a motor well rear wall, a pair of motor well side walls and a bottom surface.

9. The outboard engine bracing system recited in claim 8 wherein said support member is interposed between said transom and said bottom surface.

10. The outboard engine bracing system recited in claim 9 wherein the number of support members is three.

11. The outboard engine bracing system recited in claim 10 wherein a support member is provided between said transom and said bottom surface proximate each of said motor well side walls and the other of said support members is provided between said transom and said bottom surface towards the center of said bottom surface.

12. The outboard engine bracing system recited in claim 8 wherein said support member comprises an integral portion of said outboard extension which extends downwardly to and merges with said transom.

13. The outboard engine bracing system recited in claim 7 wherein said hull is formed of fiberglass.

* * * * *